US011299966B1

(12) United States Patent
Krueger

(10) Patent No.: US 11,299,966 B1
(45) Date of Patent: Apr. 12, 2022

(54) DISPOSABLE LINER RUNNING TOOL

(71) Applicant: Matthew J. Krueger, Cypress, TX (US)

(72) Inventor: Matthew J. Krueger, Cypress, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/243,735

(22) Filed: Apr. 29, 2021

(51) Int. Cl.
*E21B 43/10* (2006.01)

(52) U.S. Cl.
CPC ..... *E21B 43/106* (2013.01)

(58) Field of Classification Search
CPC .... E21B 43/106; E21B 43/105; E21B 43/103; E21B 43/10; E21B 23/00
See application file for complete search history.

(56) References Cited

U.S. PATENT DOCUMENTS

2001/0001420 A1* 5/2001 Miszewski ..... E21B 17/06 166/376
2005/0230115 A1* 10/2005 Rose ..... E21B 17/026 166/301
2015/0068771 A1* 3/2015 Richards ..... E21B 47/092 166/386
2017/0030159 A1* 2/2017 Vick Jr. ..... E21B 23/00
2018/0274300 A1* 9/2018 Vemuri ..... E21B 7/061
2020/0399991 A1* 12/2020 Duggan ..... E21B 23/01

* cited by examiner

*Primary Examiner* — Kipp C Wallace
(74) *Attorney, Agent, or Firm* — Cantor Colburn LLP

(57) ABSTRACT

A liner running tool includes a mandrel having a wall including outer surface and an inner surface defining a passage. A projection extends radially outwardly of the outer surface. The projection is formed from a material having a selected melting point and being configured to connect with and support a liner. A thermal activation device is operatively connected to the projection. The thermal activation device is selectively operable to melt the projection and disconnect the liner running tool from the liner.

20 Claims, 5 Drawing Sheets

DISPOSABLE LINER RUNNING TOOL

BACKGROUND

In the resource recovery industry, liners are often used to support internal wellbore surfaces as well as provide support for various downhole tools. A liner is typically anchored in a wellbore to a lowermost casing tubular through hanger slips and a packer element. The liner is run in, and secured in place with a liner running tool. The liner running tool provides a platform for holding the liner during a trip into the wellbore, supports tools used to activate packers and slips on the liner, and may also support systems for disconnecting the liner running tool from the liner. The liner running tool may support additional tools that may be used to perform other tasks. Once disconnected, the liner running tool may be used to perform the other tasks and/or be removed from the wellbore.

For example, the liner running tool generally includes various support mechanisms used to activate downhole components, e.g., slips and/or packers, as well as mechanisms that both support and release the liner. After use, the liner running tool may be discarded or rebuilt. Discarding a liner running tool is an expensive undertaking as along with the tool itself, all of the support mechanisms are also discarded. Rebuilding a liner running tool is a time consuming, expensive endeavor. Removing and rebuilding the support mechanisms takes time and requires the use of new materials. The time and new materials may raise the cost of a rebuilt liner running tool to be on par with the cost of a new tool.

SUMMARY

Disclosed is a liner running tool including a mandrel having a wall including outer surface and an inner surface defining a passage. A projection extends radially outwardly of the outer surface. The projection is formed from a material having a selected melting point and being configured to connect with and support a liner. A thermal activation device is operatively connected to the projection. The thermal activation device is selectively operable to melt the projection and disconnect the liner running tool from the liner.

Also disclosed is a resource exploration and recovery system including a surface system, a subsurface system including a casing tubular, and a liner running tool extending from the surface system into the subsurface system operable to connect a liner with the casing tubular. The liner running tool includes a mandrel having a wall having outer surface and an inner surface defining a passage. A projection extends radially outwardly of the outer surface. The projection is formed from a material having a selected melting point and is configured to connect with and support the liner. A thermal activation device is operatively connected to the projection. The thermal activation device is selectively operable to melt the projection and disconnect the liner running tool from the liner.

Further disclosed is a method of connecting a liner to a casing tubular including connecting the liner to a liner running tool through a connector member, running the liner into a wellbore with the liner running tool, anchoring the liner to the casing tubular in the wellbore, melting the connector member to separate the liner running tool and the liner, and withdrawing the liner running tool from the wellbore.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
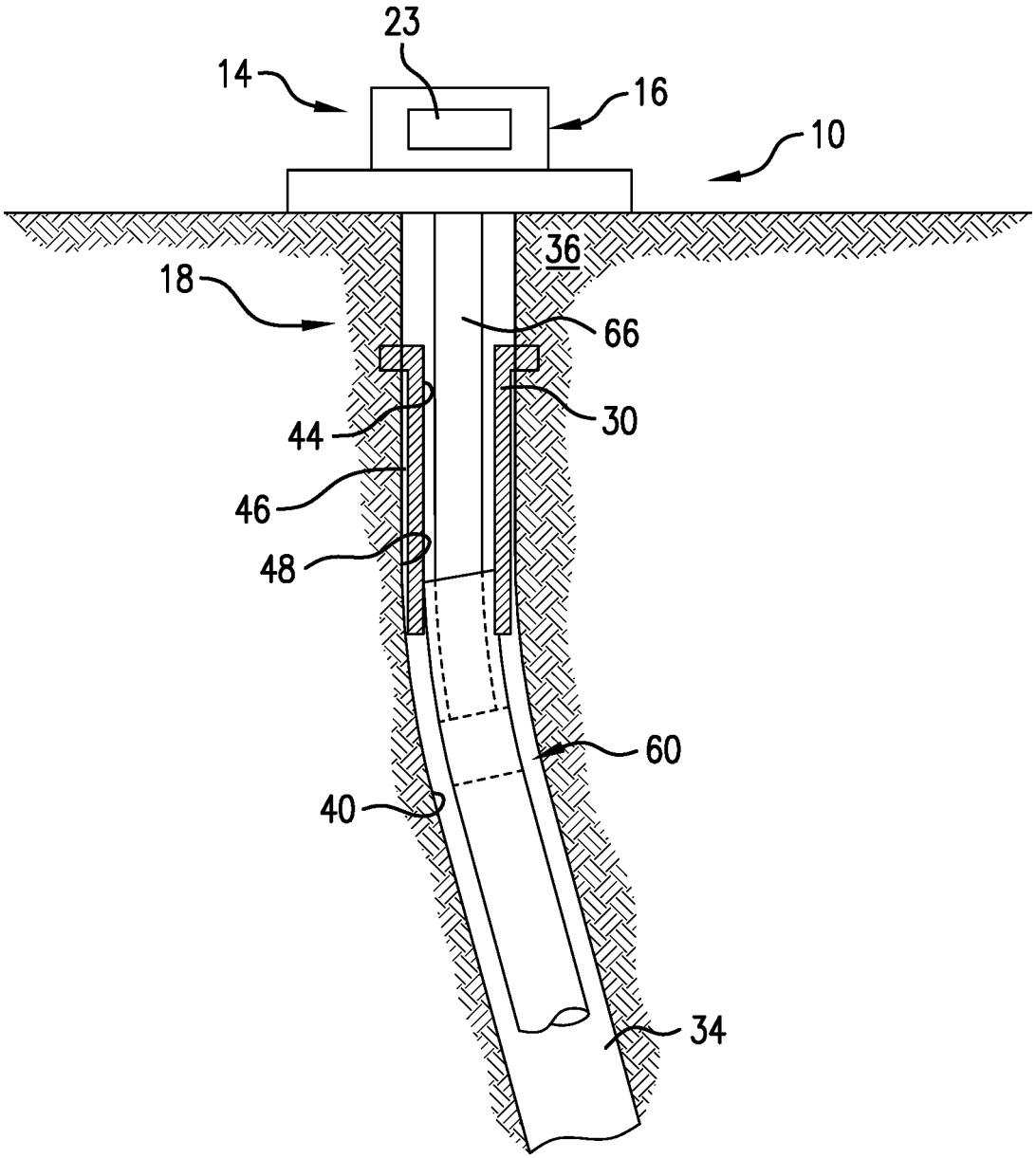
FIG. 1 depicts a resource exploration and recovery system including a disposable liner setting tool extending into a wellbore, in accordance with a non-limiting example.

A resource exploration and recovery system, in accordance with an exemplary embodiment, is indicated generally at 10, in FIG. 1. Resource exploration and recovery system 10 should be understood to support well drilling operations, completions, resource extraction and recovery, $CO_2$ sequestration, and/or the like. Resource exploration and recovery system 10 may include a first system 14 which, in some environments, may take the form of a surface system 16 operatively and fluidically connected to a second system 18 which, in some environments, may take the form of a subsurface or downhole system (not separately labeled).

First system 14 may include a control system 23 that may provide power to, monitor, communicate with, and/or activate one or more downhole operations as will be discussed herein. Surface system 16 may include additional systems such as pumps, fluid storage systems, cranes, and the like (not shown). Second system 18 may include a casing tubular 30 that extends into a wellbore 34 formed in a formation 36.

Casing tubular 30 may be part of a completion and could be formed from a plurality of interconnected tubulars (not separately labeled). Wellbore 34 includes an annular wall 40 which may be defined by a surface of formation 36. Casing tubular 30 includes an inner surface 44 and an outer surface 46. An amount of cement 48 is disposed between outer surface 46 and annular wall 40 to secure casing tubular 30 in wellbore 34. In a non-limiting example, a liner 60 is connected to inner surface 44 of casing tubular 30. Liner 60 is tripped in and secured in place with a disposable liner running tool 66.

Figure 2:
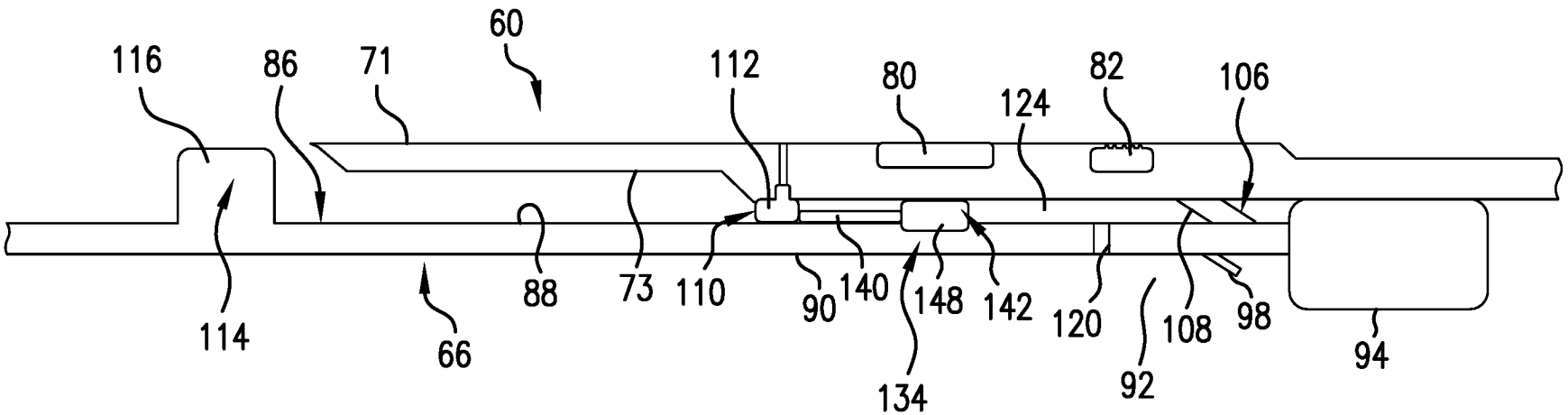
FIG. 2 depicts the disposable liner setting tool of FIG. 1 connected to a casing tubular, in accordance with a non-limiting example.

As shown in FIG. 2, liner 60 includes an outer surface portion 71 and an inner surface portion 73. Outer surface portion 71 may support a packer 80 and an anchor slip 82. Packer 80 may be radially outwardly expanded by disposable liner running tool 66 into engagement with inner surface 44 of casing tubular 30. Packer 80 forms a barrier separating a lower portion of wellbore 34, e.g., below casing tubular 30, from an upper portion of wellbore 34, e.g., above casing tubular 30. Anchor slip 82 include a plurality of teeth (not separately labeled) that bite into inner surface 44 of casing tubular 30. Anchor slips 82 mechanically link liner 60 to casing tubular 30.

In a non-limiting example, disposable liner running tool 66 includes a mandrel 86 having an outer surface section 88 and an inner surface section 90 that defines a conduit 92. Mandrel 86 may support a liner wiper plug 94 and a ball seat 98. Liner wiper plug 94 may be used to clean inner surface portion 73 of liner 60. Ball seat 98 may extend from inner surface section 90 into conduit 92. Disposable liner running tool 66 further includes a first projection 106 provided on outer surface section 88. First projection 106 may take the form of a swab cup 108 that may be employed to lift water or other substance in wellbore 34. Disposable liner running tool 66 also includes a second projection 110 that takes the form of a connector member 112 that selectively supports liner 60 and a third projection 114 that takes the form of a packer setting member 116. In accordance with a non-limiting example, connector member 112 may also provide a seal between liner 60 and a tubular string (not separately labeled) extending downhole. Additionally, connector member 112 may transmit torque and/or compression forces to liner 60.

Figure 3:
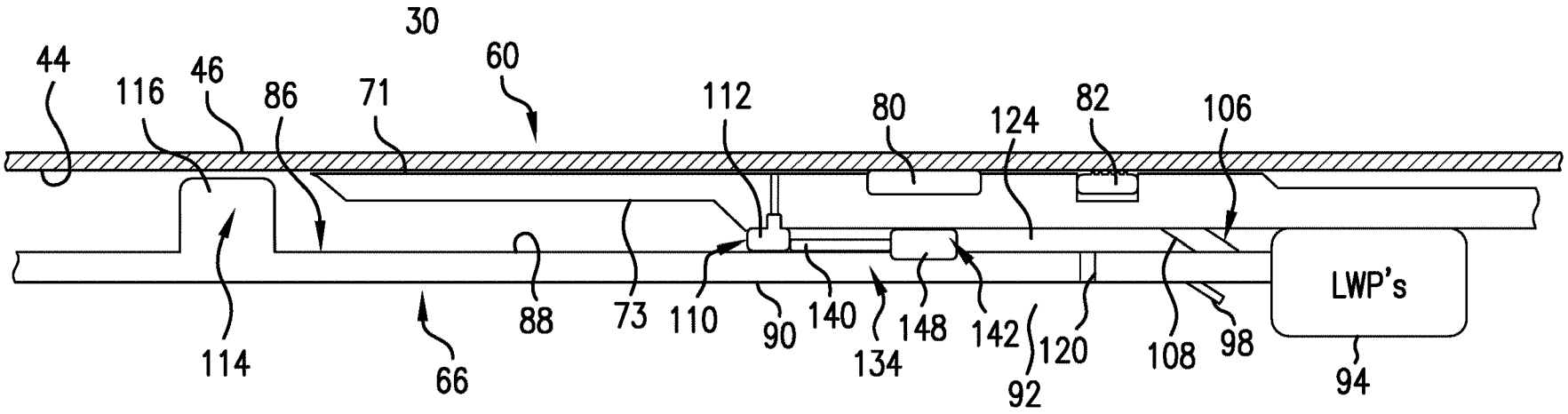
FIG. 3 depicts the disposable liner running tool of FIG. 2 activating anchor slips and a packer, in accordance with a non-limiting example.

For example, a drop ball (not shown) may be introduced into conduit 92 and supported at ball seat 98. An amount of fluid may be introduced into conduit 92 at a selected pressure. The amount of fluid may pass through a passage 120 formed between outer surface section 88 and inner surface section 90 and into a chamber 124 defined, in a radial direction, between inner surface portion 73 of casing tubular 30 and outer surface section 88 of liner 60 and, in an axial direction, between first projection 106 and connector member 112. Pressure in chamber 124 may be raised to activate anchor slip 82 and packer setting member 116 may be guided into liner 60 to set or radially outwardly expand packer 80 such as shown in FIG. 3.

In a non-limiting example, connector member 112 is formed from a material that may be readily removed from disposable liner running tool 66. In a non-limiting example, the material may have a selected melting point. The selected melting point is higher than subterranean temperatures. Subterranean temperatures may be in a range between about 150° F. (65.5° C.) and about 350° F. (176.6° C.). In a non-limiting example, connector member 112 is formed from a material having a melting point that may be between about 350° F. (176.6° C.) and about 700° F. (371° C.).

In another non-limiting example, connector member 112 may be formed from a metal, a metal alloy, a composite structure that may include an energetic material and/or a eutectic alloy such as bismuth. In the case of a eutectic material, connector member 112 may be formed by introducing or flowing the material into chamber 124. The material will harden and engage with structure (not shown) on inner surface portion 73 of casing tubular 30 and outer surface section 88 of liner 60.

As will be detailed herein, connector member 112 is a sacrificial element that is selectively removed in order to separate disposable liner running tool 66 from liner 60. In a non-limiting example, material for connector member 112 may be heated so as to be flowable and introduced into chamber 124. The material may then flow into features (not separately labeled) on each of inner surface portion 73 and outer surface section 88 and allowed to harden forming connector member 112.

In a non-limiting example, disposable liner running tool 66 may also support a thermal activation device 134 that initiates the removal of connector member 112. Thermal activation device 134 that is connected to connector member 112 through an activation delivery path 140. Thermal activation device 134 may take on a variety of forms. For example, when connector member 112 is formed from a material including an energetic material, thermal activation device 134 may include an electronic actuation member in the form of an electric circuit or processor that delivers an activation input, that could take the form of an electrical current, along activation delivery path 140 to energize the energetic material creating an amount of heat energy that removes connector member 112.

Figure 4:
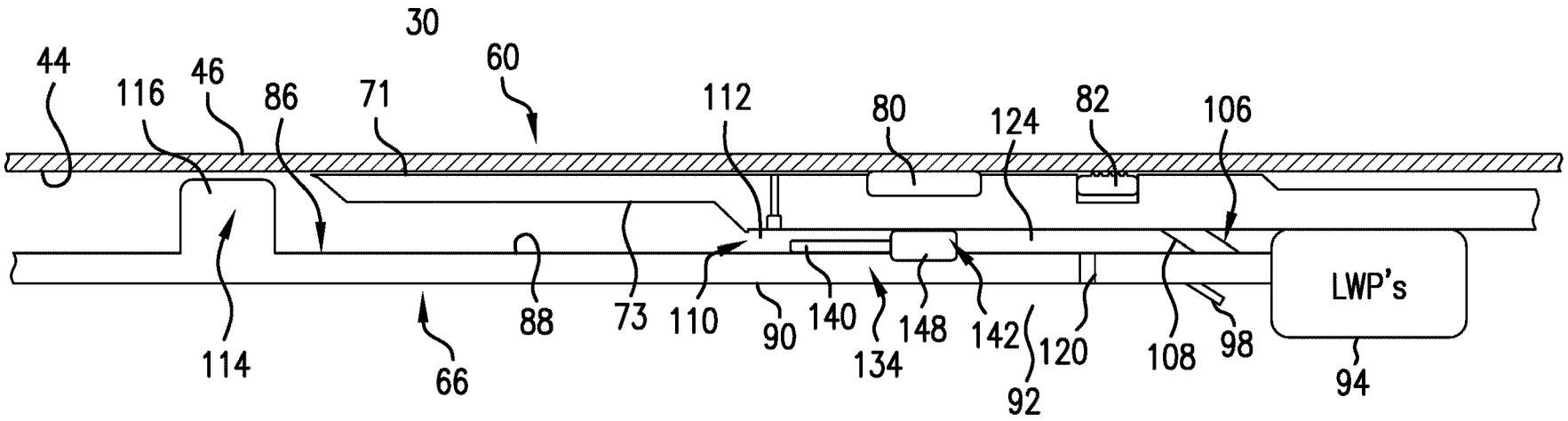
FIG. 4 depicts the disposable liner running tool disengaging from the casing tubular by removing a connector member, in accordance with a non-limiting example.
Figure 5:
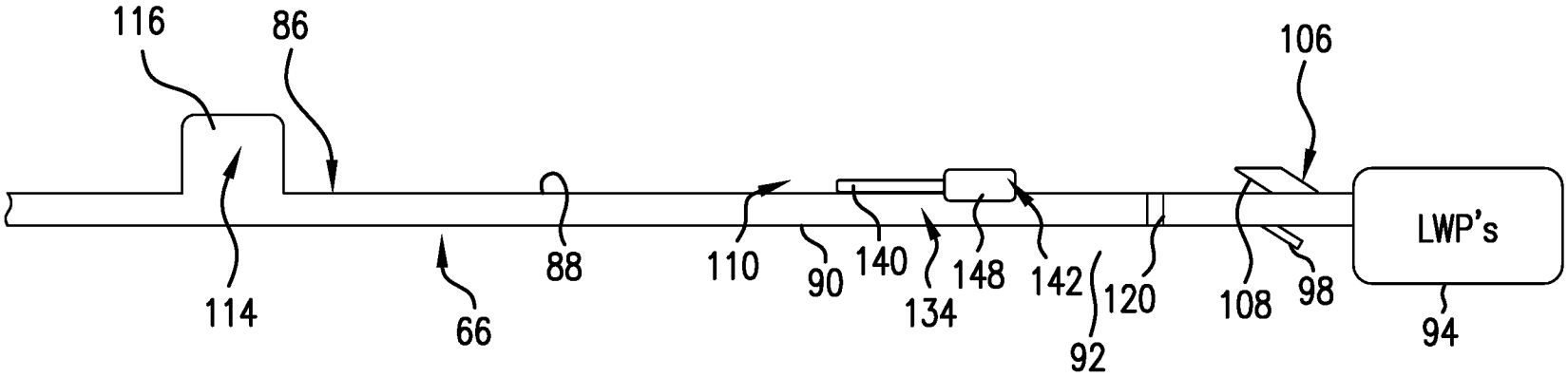
FIG. 5 depicts the disposable liner running tool being withdrawn from the wellbore after removal of the connector member, in accordance with a non-limiting example.

When connector member 112 is formed from a meltable material or composite, thermal activation device 134 may also take the form of a heat delivery device 148 that delivers an amount of heat from a heat source along activation delivery path 140. The heat source could take on a variety of forms including a chemical heat source that creates heat through a chemical reaction such as by combining elements, igniting a gas, and/or igniting a solid, activation of an electric resistance heater, activation of an inductive heating device and the like. The amount of heat is directed onto connector member 112. When exposed to the amount of heat, connector member 112 melts as shown in FIG. 4 thereby disengaging disposable liner running tool 66 from liner 60. At this point, disposable liner running tool 66 may be used to clean inner surface portion 73 of liner 60 or be withdrawn from wellbore 34 as shown in FIG. 5.

By forming the connector member as a sacrificial element, the liner running tool, in accordance with non-limiting examples, becomes a readily disposable component. That is, once the connector member is melted or otherwise made non-functional, the mandrel may be easily recycled. This results in a significant cost savings as there is no longer a need to invest time and money in reclaiming/removing non-recyclable components of more complicated connectors. Further, eliminating the more complicated connectors also reduces the cost and time associated with preparing a liner running tool for use.

Set forth below are some embodiments of the foregoing disclosure:

Embodiment 1. A liner running tool comprising: a mandrel including a wall having outer surface and an inner surface defining a passage; a projection extending radially outwardly of the outer surface, the projection being formed from a material having a selected melting point and being configured to connect with and support a liner; and a thermal activation device operatively connected to the projection, the thermal activation device being selectively operable to melt the projection and disconnect the liner running tool from the liner.

Embodiment 2. The liner running tool according to any prior embodiment, further comprising: another projection spaced from the projection, the another projecting comprising a swab cup.

Embodiment 3. The liner running tool according to any prior embodiment, further comprising: a passage extending through the wall between the projection and the another projection.

Embodiment 4. The liner running tool according to any prior embodiment, wherein the thermal activation device includes one of a chemical heat source, an energetic material, an electric resistance heater, and an inductive heating device operable to melt the projection.

Embodiment 5. The liner running tool according to any prior embodiment, wherein the thermal activation device includes an activation delivery path coupled to the projection.

Embodiment 6. The liner running tool according to any prior embodiment, wherein the thermal activation device includes a heat source arranged in the activation delivery path.

Embodiment 7. The liner running tool according to any prior embodiment, wherein the thermal activation device includes an electronic actuation member coupled to the activation delivery path.

Embodiment 8. A resource exploration and recovery system comprising: a surface system; a subsurface system including a casing tubular; and a liner running tool extending from the surface system into the subsurface system operable to connect a liner with the casing tubular, the liner running tool comprising: a mandrel including a wall having outer surface and an inner surface defining a passage; a projection extending radially outwardly of the outer surface, the projection being formed from a material having a selected melting and being configured to connect with and support the liner; and a thermal activation device operatively connected to the projection, the thermal activation device being selectively operable to melt the projection and disconnect the liner running tool from the liner.

Embodiment 9. The resource exploration and recovery system according to any prior embodiment, further comprising: another projection spaced from the projection, the another projection comprising a swab cup.

Embodiment 10. The resource exploration and recovery system according to any prior embodiment, further comprising: a passage extending through the wall between the projection and the another projection.

Embodiment 11. The resource exploration and recovery system according to any prior embodiment, wherein the thermal activation device includes one of a chemical heat source, an energetic material, an electric resistance heater, and an inductive heating device operable to melt the projection.

Embodiment 12. The resource exploration and recovery system according to any prior embodiment, wherein the thermal activation device includes an activation delivery path coupled to the projection.

Embodiment 13. The resource exploration and recovery system according to any prior embodiment, wherein the thermal activation device includes a heat source arranged in the activation delivery path.

Embodiment 14. The resource exploration and recovery system according to any prior embodiment, wherein the thermal activation device includes an electronic actuation member coupled to the activation delivery path.

Embodiment 15. A method of connecting a liner to a casing tubular comprising: connecting the liner to a liner running tool through a connector member; running the liner into a wellbore with the liner running tool; anchoring the liner to the casing tubular in the wellbore; melting the connector member to separate the liner running tool and the liner; and withdrawing the liner running tool from the wellbore.

Embodiment 16. The method according to any prior embodiment, wherein melting the connector member includes activating a thermal activation device.

Embodiment 17. The method according to any prior embodiment, wherein activating the thermal activation device includes activating one of a chemical heat source, an energetic material, an electric resistance heater, and an inductive heating device.

Embodiment 18. The method according to any prior embodiment, further comprising delivering an amount of fluid into a chamber defined between the connector member and a projection extending radially outwardly from the liner running tool.

Embodiment 19. The method according to any prior embodiment, wherein delivering the amount of fluid includes passing the amount of fluid through a passage formed in the liner running tool.

Embodiment 20. The method according to any prior embodiment, wherein delivering the amount of fluid into the chamber includes activating one of a packer and an anchor slip mounted to the liner.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A liner running tool comprising:

a mandrel including a wall having outer surface and an inner surface defining a passage;

a projection extending radially outwardly of the outer surface, the projection being formed from a material having a selected melting point and being configured to connect with and support a liner; and a thermal activation device operatively connected to the projection, the thermal activation device being selectively operable to melt the projection and disconnect the liner running tool from the liner.

2. The liner running tool according to claim 1, further comprising: another projection spaced from the projection, the another projecting comprising a swab cup.

3. The liner running tool according to claim 2, further comprising: a passage extending through the wall between the projection and the another projection.

4. The liner running tool according to claim 1, wherein the thermal activation device includes one of a chemical heat source, an energetic material, an electric resistance heater, and an inductive heating device operable to melt the projection.

5. The liner running tool according to claim 1, wherein the thermal activation device includes an activation delivery path coupled to the projection.

6. The liner running tool according to claim 5, wherein the thermal activation device includes a heat source arranged in the activation delivery path.

7. The liner running tool according to claim 6, wherein the thermal activation device includes an electronic actuation member coupled to the activation delivery path.

8. A resource exploration and recovery system comprising:

a surface system;

a subsurface system including a casing tubular; and a liner running tool extending from the surface system into the subsurface system operable to connect a liner with the casing tubular, the liner running tool comprising:

a mandrel including a wall having outer surface and an inner surface defining a passage;

a projection extending radially outwardly of the outer surface, the projection being formed from a material having a selected melting and being configured to connect with and support the liner; and a thermal activation device operatively connected to the projection, the thermal activation device being selectively operable to melt the projection and disconnect the liner running tool from the liner.

9. The resource exploration and recovery system according to claim 8, further comprising: another projection spaced from the projection, the another projection comprising a swab cup.

10. The resource exploration and recovery system according to claim 9, further comprising: a passage extending through the wall between the projection and the another projection.

11. The resource exploration and recovery system according to claim 8, wherein the thermal activation device includes one of a chemical heat source, an energetic material, an electric resistance heater, and an inductive heating device operable to melt the projection.

12. The resource exploration and recovery system according to claim 8, wherein the thermal activation device includes an activation delivery path coupled to the projection.

13. The resource exploration and recovery system according to claim 12, wherein the thermal activation device includes a heat source arranged in the activation delivery path.

14. The resource exploration and recovery system according to claim 13, wherein the thermal activation device includes an electronic actuation member coupled to the activation delivery path.

15. A method of connecting a liner to a casing tubular comprising:

connecting the liner to a liner running tool through a connector member;

running the liner into a wellbore with the liner running tool;

anchoring the liner to the casing tubular in the wellbore;

melting the connector member to separate the liner running tool and the liner; and withdrawing the liner running tool from the wellbore.

16. The method of claim 15, wherein melting the connector member includes activating a thermal activation device.

17. The method of claim 16, wherein activating the thermal activation device includes activating one of a chemical heat source, an energetic material, an electric resistance heater, and an inductive heating device.

18. The method of claim 15, further comprising: delivering an amount of fluid into a chamber defined between the connector member and a projection extending radially outwardly from the liner running tool.

19. The method of claim 18, wherein delivering the amount of fluid includes passing the amount of fluid through a passage formed in the liner running tool.

20. The method of claim 18, wherein delivering the amount of fluid into the chamber includes activating one of a packer and an anchor slip mounted to the liner.

* * * * *